US009217340B2

(12) United States Patent
Moon et al.

(10) Patent No.: US 9,217,340 B2
(45) Date of Patent: Dec. 22, 2015

(54) BI-DIRECTIONAL CONTROL GROOVE DESIGN FOR ENGINE ROTATION REVERSAL ON ENGINE WITH SLIDING CAMSHAFT

(71) Applicant: GM GLOBAL TECHNOLOGY OPERATIONS LLC, Detroit, MI (US)

(72) Inventors: Joseph J. Moon, Clawson, MI (US); Domenic Certo, Niagra Falls (CA)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/310,596

(22) Filed: Jun. 20, 2014

(65) Prior Publication Data

US 2015/0233272 A1 Aug. 20, 2015

Related U.S. Application Data

(60) Provisional application No. 61/939,876, filed on Feb. 14, 2014.

(51) Int. Cl.

| | |
|---|---|
| ***F01L 1/34*** | (2006.01) |
| ***F01L 13/00*** | (2006.01) |
| *F01L 1/344* | (2006.01) |
| *F01L 1/047* | (2006.01) |

(52) U.S. Cl.

CPC ..... *F01L 13/0042* (2013.01); *F01L 1/34413* (2013.01); *F01L 2001/0473* (2013.01)

(58) Field of Classification Search

CPC ..... F01L 1/34413; F01L 2001/0473; F01L 13/0042

USPC ..... 123/90.18, 90.6

See application file for complete search history.

(56) References Cited

U.S. PATENT DOCUMENTS 8,893,674 B2 * 11/2014 Lengfeld et al. ..... 123/90.16
2010/0175652 A1 * 7/2010 Schoeneberg et al.
2011/0079191 A1 * 4/2011 Lengfeld et al.

FOREIGN PATENT DOCUMENTS

WO WO 2008107106 A1 * 9/2008

* cited by examiner

*Primary Examiner* — Ching Chang
(74) *Attorney, Agent, or Firm* — Quinn Law Group, PLLC

(57) ABSTRACT

A camshaft assembly includes a camshaft rotatable about a cam axis, and a lobe pack slideably attached to the camshaft. The lobe pack includes a barrel cam that defines a control groove disposed annularly about the cam axis. When the camshaft and the lobe pack rotate about the cam axis in a first rotational direction, the control groove is shaped to react against either a first or second shifting pin, to guide the lobe pack along a first or third path respectively, into a first or second axial position respectively. When the camshaft and the lobe pack rotate about the cam axis in a second rotational direction, the control groove is shaped to react against the first and second shifting pins to guide the lobe pack along a second path, into the second axial position.

17 Claims, 3 Drawing Sheets

BI-DIRECTIONAL CONTROL GROOVE DESIGN FOR ENGINE ROTATION REVERSAL ON ENGINE WITH SLIDING CAMSHAFT

CROSS-REFERENCE TO RELATED APPLICATIONS

This application claims the benefit of U.S. Provisional Patent Application Ser. No. 61/939,876, filed on Feb. 14, 2014, the disclosure of which is hereby incorporated by reference.

TECHNICAL FIELD

The disclosure generally relates to a camshaft assembly for an internal combustion engine.

BACKGROUND

Some internal combustion engines include an adjustable or slideable camshaft assembly. The camshaft assembly includes a base camshaft that is rotatable about a cam axis. A lobe pack is slideably attached to the camshaft for axial movement along the cam axis relative to the camshaft. The lobe pack is rotatable with the camshaft about the cam axis. The lobe pack is moveable between at least two different axial positions along the cam axis. Each different position of the lobe pack presents a different cam lobe having a different lobe profile for engaging a respective valve stem of the engine. Accordingly, by adjusting the position of the lobe pack, the cam profile that each valve stem of the engine follows may be changed.

The lobe pack includes a barrel cam that defines a control groove disposed annularly about the cam axis. A first shifting pin is moveable along a first pin axis in a direction transverse to the cam axis. The first shifting pin moves between an engaged position and a disengaged position. When disposed in the engaged position, the first shifting pin is engaged with the control groove, such that interaction between the first shifting pin and the control groove moves the lobe pack axially along the cam axis relative to the camshaft, in a first axial direction and into a first axial position, as the lobe pack rotates about the cam axis with the camshaft. A second shifting pin is moveable along a second pin axis in a direction transverse to the cam axis. The second shifting pin moves between an engaged position and a disengaged position. When disposed in the engaged position, the second shifting pin is engaged with the control groove, such that interaction between the second shifting pin and the control groove moves the lobe pack axially along the cam axis relative to the camshaft, in a second axial direction and into a second axial position, as the lobe pack rotates about the cam axis with the camshaft. When disposed in their respective disengaged positions, the first shifting pin and the second shifting pin are disengaged from the control groove such that the lobe pack remains positionally fixed along the cam axis, relative to the camshaft, as the lobe pack rotates about the cam axis with the camshaft. The lobe pack remains positionally fixed relative to the camshaft via an interlocking detent ball and detent groove retention mechanism disposed on the lobe pack and the camshaft respectively.

During normal operation, the camshaft and the lobe pack only rotate about the cam axis in a first rotational direction. The control groove is shaped to engage the first shifting pin and the second shifting pin, to guide the lobe pack between the first axial position and the second axial position along the cam axis respectively, when the camshaft and the lobe pack are rotating in the first rotational direction.

SUMMARY

An internal combustion engine is provided. The internal combustion engine includes a camshaft that is rotatable about a cam axis. A lobe pack is slideably attached to the camshaft for axial movement along the cam axis relative to the camshaft. The lobe pack is rotatable with the camshaft about the cam axis. The lobe pack includes a barrel cam defining a control groove disposed annularly about the cam axis. A first shifting pin is moveable along a first pin axis in a direction transverse to the cam axis, between an engaged position and a disengaged position. The first shifting pin is engaged with the control groove when disposed in the engaged position, such that interaction between the first shifting pin and the control groove moves the lobe pack axially along the cam axis relative to the camshaft, in a first axial direction, as the lobe pack rotates about the cam axis with the camshaft. A second shifting pin is moveable along a second pin axis in a direction transverse to the cam axis, between an engaged position and a disengaged position. The second shifting pin is engaged with the control groove when disposed in the engaged position, such that interaction between the second shifting pin and the control groove moves the lobe pack axially along the cam axis relative to the camshaft, in a second axial direction, opposite the first axial direction, as the lobe pack rotates about the cam axis with the camshaft. The first shifting pin and the second shifting pin are disengaged from the control groove when disposed in their respective disengaged positions, such that the lobe pack remains positionally fixed along the cam axis relative to the camshaft as the lobe pack rotates about the cam axis with the camshaft, when both the first shifting pin and the second shifting pin are disposed in their respective disengaged positions. The control groove is shaped to engage the first shifting pin and guide the lobe pack along a first path to position the lobe pack in a first axial position relative to the camshaft, when the camshaft and the lobe pack rotate about the cam axis in a first rotational direction. The control groove is shaped to engage the second shifting pin and guide the lobe pack along a third path to position the lobe pack in a second axial position relative to the camshaft, when the camshaft and the lobe pack rotate about the cam axis in the first rotational direction. The control groove is shaped to engage either the first shifting pin or the second shifting pin and guide the lobe pack along a second path to position the lobe pack in the second axial position relative to the camshaft, when the camshaft and the lobe pack rotate about the cam axis in a second rotational direction.

A camshaft assembly for an internal combustion engine is also provided. The camshaft assembly includes a camshaft that is rotatable about a cam axis. A lobe pack is slideably attached to the camshaft for axial movement along the cam axis relative to the camshaft. The lobe pack is rotatable with the camshaft about the cam axis. The lobe pack includes a barrel cam that defines a control groove disposed annularly about the cam axis. The control groove is shaped to react against a first shifting pin to guide the lobe pack along a first path, to position the lobe pack in a first axial position relative to the camshaft, when the camshaft and the lobe pack rotate about the cam axis in a first rotational direction. The control groove is shaped to react against a second shifting pin to guide the lobe pack along a third path, to position the lobe pack in a second axial position relative to the camshaft, when the camshaft and the lobe pack rotate about the cam axis in the first rotational direction. The control groove is shaped to react against either the first shifting pin or the second shifting pin to guide the lobe pack along a second path, to position the lobe pack in the second axial position relative to the camshaft, when the camshaft and the lobe pack rotate about the cam axis in a second rotational direction.

Accordingly, the control groove is shaped to engage either the first shifting pin or the second shifting pin to guide the lobe pack when rotating in either the first rotational direction, or the second rotational direction. During normal operation, the camshaft and the lobe pack only rotate in the first rotational direction. However, in the event that the camshaft and the lobe pack rotate in the second rotational direction, the control groove is shaped to engage either the first shifting pin or the second shifting pin and guide the lobe pack along the second path. Because the control groove is shaped to guide the lobe pack when rotating in either rotational direction, the first shifting pin and the second shifting pin are protected from damage.

The above features and advantages and other features and advantages of the present teachings are readily apparent from the following detailed description of the best modes for carrying out the teachings when taken in connection with the accompanying drawings.

DETAILED DESCRIPTION

Figure 1:
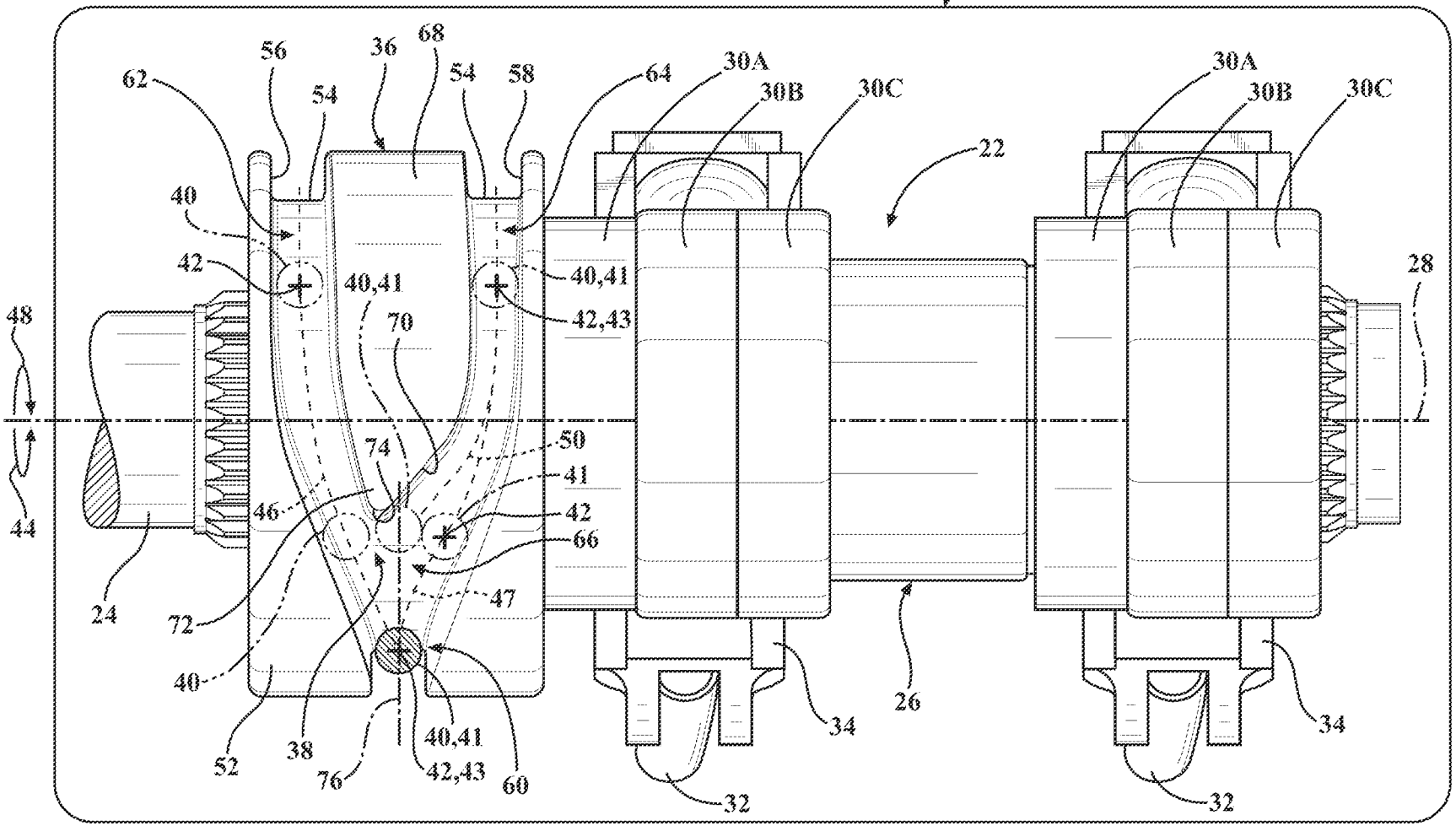
FIG. 1 is a schematic plan view of a camshaft assembly of an internal combustion engine, with the camshaft assembly shown in a first position.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the disclosure may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, an internal combustion engine is generally shown at 20. The internal combustion engine 20 includes a sliding camshaft assembly 22. The sliding camshaft assembly 22 includes a camshaft 24, and a lobe pack 26 slideably attached to the camshaft 24. The camshaft 24 is rotatable about a cam axis 28. The lobe pack 26 is slideably attached to the camshaft 24 for axial movement along the cam axis 28 relative to the camshaft 24, and is rotatable with the camshaft 24 about the cam axis 28. For example, the lobe pack 26 may be attached to the camshaft 24 via a splined connection allowing the lobe pack 26 to slide along cam axis 28 relative to the camshaft 24, while transmitting torque between the camshaft 24 and the lobe pack 26. The lobe pack 26 includes a plurality of lobes 30 for each valve stem 32 of the internal combustion engine 20. As shown in the Figures, the plurality of lobes 30 includes a first lobe 30A, a second lobe 30B, and a third lobe 30C. The lobes for each valve stem 32 are referred to generally in the written specification by reference numeral 30, and are shown in the drawings and specifically described in the written specification by their respective reference numerals 30A, 30B, and 30C. Each lobe 30 for each valve stem 32 may define a different profile perpendicular to the cam axis 28. Alternatively, two of the lobes 30 may define an identical profile perpendicular to the cam axis 28. For example, and as shown, the second lobe 30B and the third lobe 30C each define an identical cam profile. The lobe pack 26 slides along the camshaft 24 between different positions, to position different sets of lobes 30 on the lobe pack 26 adjacent the valve stems 32. By changing the axially position of the lobe pack 26 relative to the camshaft 24, the lift for each valve stem 32 may be altered. A roller finger follower 34 may be positioned between the lobe pack 26 and each of the respective valve stems 32 as is known in the art.

The lobe pack 26 includes a barrel cam 36. As shown, the barrel cam 36 is disposed at an axial end of the lobe pack 26. However, the barrel cam 36 may be disposed at some other axial location along the lobe pack 26, such as between adjacent sets of lobes 30 The barrel cam 36 defines a control groove 38 that is disposed annularly about the cam axis 28. The internal combustion engine 20 includes a first shifting pin 40 that is moveable along a first pin axis 42, in a direction transverse to the cam axis 28. The first shifting pin 40 is axially fixed in position along the cam axis 28, relative to the cam shaft. As such, the first shifting pin 40 does not move axially along the cam axis 28, relative to the camshaft 24, but only moves transverse relative to the camshaft 24. The first shifting pin 40 may be attached to and supported by any suitable feature of the internal combustion engine 20, capable of positioning the first shifting pin 40 relative to the camshaft 24. For example, the first shifting pin 40 is preferably attached to and supported by a cam cover (not shown) of the internal combustion engine 20.

The first shifting pin 40 is moveable between an engaged position and a disengaged position. When disposed in the engaged position, the first shifting pin 40 is engaged with the control groove 38 such that interaction between the first shifting pin 40 and the control groove 38 moves the lobe pack 26 axially along the cam axis 28, relative to the camshaft 24, into a first axial position, as the lobe pack 26 rotates about the cam axis 28 with the camshaft 24 in a first rotational direction 44.

The internal combustion engine 20 further includes a second shifting pin 41 that is moveable along a second pin axis 43, in a direction transverse to the cam axis 28. The second shifting pin 41 is axially fixed in position along the cam axis 28, relative to the cam shaft. As such, the second shifting pin 41 does not move axially along the cam axis 28, relative to the camshaft 24, but only moves transverse relative to the camshaft 24. The second shifting pin 41 may be attached to and supported by any suitable feature of the internal combustion engine 20, capable of positioning the second shifting pin 41 relative to the camshaft 24. For example, the second shifting pin 41 is preferably attached to and supported by a cam cover (not shown) of the internal combustion engine 20.

The second shifting pin 41 is moveable between an engaged position and a disengaged position. When disposed in the engaged position, the second shifting pin 41 is engaged with the control groove 38 such that interaction between the second shifting pin 41 and the control groove 38 moves the lobe pack 26 axially along the cam axis 28, relative to the camshaft 24, into a second axial position, as the lobe pack 26 rotates about the cam axis 28 with the camshaft 24 in the first rotational direction 44.

When disposed in their respective disengaged positions, the first shifting pin 40 and the second shifting pin 41 are disengaged from the control groove 38. When both of the first shifting pin 40 and the second shifting pin 41 are disposed in their respective disengaged position, the lobe pack 26 remains positionally fixed along the cam axis 28 relative to the camshaft 24, as the lobe pack 26 rotates about the cam axis 28 with the camshaft 24. The camshaft assembly 22 may include a retention mechanism (not shown) that positionally secures the lobe pack 26 relative to the camshaft 24. The retention mechanism may include, but is not limited to, a spring loaded ball and groove detent system.

During normal operation of the internal combustion engine 20, when the camshaft 24 and the lobe pack 26 rotate about the cam axis 28 in the first rotational direction 44, the control groove 38 is shaped to engage the first shifting pin 40 and guide the lobe pack 26 along a first path 46, to position the lobe pack 26 in the first axial position relative to the camshaft 24. The first path 46 is generally shown in phantom by the line 46. Because the first shifting pin 40 remains axially stationary relative to the cam axis 28, the first path 46 is defined by the combination of the rotational and axial movement of the lobe pack 26 relative to the cam axis 28.

Furthermore, during normal operation of the internal combustion engine 20, when the camshaft 24 and the lobe pack 26 rotate about the cam axis 28 in the first rotational direction 44, the control groove 38 is shaped to engage the second shifting pin 41 and guide the lobe pack 26 along a third path 47, to position the lobe pack 26 in the second axial position relative to the camshaft 24. The third path 47 is generally shown in phantom by the line 47. Because the second shifting pin 41 remains axially stationary relative to the cam axis 28, the third path 47 is defined by the combination of the rotational and axial movement of the lobe pack 26 relative to the cam axis 28.

When the camshaft 24 and the lobe pack 26 rotate about the cam axis 28 in a second rotational direction 48, which is opposite the first rotational direction 44, such as may occur during an engine rotation reversal, the control groove 38 is shaped to engage either the first shifting pin 40 or the second shifting pin 41 and guide the lobe pack 26 along a second path 50, to position the lobe pack 26 in the second axial position relative to the camshaft 24. The second path 50 is generally shown in phantom by the line 50. Because both the first shifting pin 40 and the second shifting pin 41 remain axially stationary relative to the cam axis 28, the second path 50 is defined by the combination of the rotational and axial movement of the lobe pack 26 relative to the cam axis 28.

Because both the first shifting pin 40 and the second shifting pin 41 remain axially stationary relative to the cam axis 28, the second axial position of the lobe pack 26 will vary depending upon which of the first shifting pin 40 and the second shifting pin 41 is being guided along the second path 50. Particularly, if the control groove 38 is guiding the first shifting pin 40 along the second path 50, then the second axial position of the lobe pack 26 is defined by having the third lobes 30C aligned with their respective valve stem 32. However, if the control groove 38 is guiding the second shifting pin 41 along the second path, then the second axial position of the lobe pack 26 is defined by having the second lobes 30B aligned with their respective valve stem 32. However, because the cam profile of the second lobe 30B and the third lobe 30C are identical, the movement of the valve stems, when the lobe pack 26 is disposed in the second axial position, is identical.

The control groove 38 is recessed into an exterior circumferential surface 52 of the barrel cam 36 to define a bottom groove surface 54, a first side groove surface 56, and a second side groove surface 58. The bottom groove surface 54 extends, at least partially, circumferentially around the cam axis 28. The first side groove surface 56 and the second side groove surface 58 extend radially outward from the bottom groove surface 54, away from the cam axis 28. The bottom groove surface 54, the first side groove surface 56, and the second side groove surface 58 cooperate to define the control groove 38 therebetween.

The control groove 38 includes a pin ejection portion 60, a first position portion 62, a second position portion 64, and a shift portion 66. The first position portion 62 and the second position portion 64 are each disposed parallel with each other, and at least partially extend circumferentially around the cam axis 28. The first position portion 62 and the second position portion 64 of the control groove 38 are disposed substantially perpendicular to the cam axis 28. The shift pin ejection portion 60 of the control groove 38 is axially disposed between the first position portion 62 and the second position portion 64, along the cam axis 28. The shift pin ejection portion 60 defines a radial ramp to bias the shifting pin 40 from the engaged position into the disengaged position as the lobe pack 26 rotates about the cam axis 28 in the first rotational direction 44. The shift portion 66 of the control groove 38 connects the first position portion 62 and the second position portion 64 with the shift pin ejection portion 60. The shift portion 66 transitions the first path 46 from the first position portion 62 into the pin ejection portion 60. The shift portion 66 transitions the third path 47 from the second position portion 64 into the pin ejection portion 60. The shift portion 66 transitions the second path 50 from the pin ejection portion 60 into the second position portion 64. The shift portion 66 of the control groove 38 is the portion of the control groove 38 that interacts with the first shifting pin 40 and the second shifting pin 41 to cause the lobe pack 26 to move axially along the cam axis 28 between the different axial positions.

The barrel cam 36 includes a central guide portion 68 that is disposed within the control groove 38. The central guide portion 68 extends radially outward from the bottom groove surface 54, and away from the cam axis 28. The central guide portion 68 is disposed between the first side groove surface 56 and the second side groove surface 58 to partially bifurcate the control groove 38 into the first position portion 62 and the second position portion 64 respectively, and thereby partially defining the first path 46, the third path 47, and the second path 50.

The control groove 38 includes a reverse rotation guide surface 70, which is positioned to engage either the first shifting pin 40 or the second shifting pin 41 when the lobe pack 26 rotates in the second rotational direction 48. The reverse rotation guide surface 70 operates to guide the lobe pack 26 along the second path 50, and move the lobe pack 26 axially along the cam axis 28 relative to the camshaft 24. Accordingly, in the event the normal rotation of the camshaft 24 in the first rotational direction 44 is stopped, and the camshaft 24 rotates in the second rotational direction 48, i.e., a reverse rotation, then the reverse rotation guide surface 70 engages either the first shifting pin 40 or the second shifting pin 41 to guide the lobe pack 26 along the second path 50. The reverse rotation guide surface 70 is angled relative to the second rotational direction 48, in order to bias the lobe pack 26 away from the first shifting pin 40 and the second shifting pin 41, as the lobe pack 26 rotates relative to the first shifting pin 40 and the second shifting pin 41.

As shown, the central guide portion 68 presents and/or defines the reverse rotation guide surface 70. The central guide portion 68 includes an end portion 72, which defines the reverse rotation guide surface 70. The end portion 72, and thereby the reverse rotation guide surface 70, are disposed within the shift portion 66 of the control groove 38. The end portion 72 includes an apex 74 that is disposed opposite the pin ejection portion 60 of the control groove 38. The apex 74 of the end portion 72 is the lower point of the central guide portion 68 as viewed on the page of the Figures.

The apex 74 is not centered along a centerline 76 of the pin ejection portion 60 of the control groove 38. Rather, the apex 74 of the end portion 72 is axially offset, along the cam axis 28, relative to the centerline 76 of the pin ejection portion 60 of the control groove 38. As such, in the event that the camshaft 24 and the lobe pack 26 rotate in the second rotational direction 48, the first shifting pin 40 and the second shifting pin 41 contact the reverse rotation guide surface 70, without contacting or otherwise impinging upon the apex 74. By contacting the reverse rotation guide surface 70, and not the apex 74 of the central guide portion 68, the reverse rotation guide surface 70 may bias the lobe pack 26 away from the first shifting pin 40 or the second shifting pin 41, as the lobe pack 26 rotates in the second rotational direction 48.

As shown, the apex 74 is disposed axially nearer the first position portion 62 of the control groove 38 than the second position portion 64 of the control groove 38. Preferably, the apex 74 is substantially aligned along the cam axis 28 with the first side surface of the pin ejection portion 60 of the control groove 38. The reverse rotation guide surface 70 is shown in the Figures in a configuration that biases the lobe pack 26 to the left of the page as viewed in the Figures, so that the first shifting pin 40 and the second shifting pin 41 are directed toward and into the second position portion 64 of the control groove 38. However, it should be appreciated that the apex 74 and the reverse rotation guide surface 70 may be configured differently, with the apex 74 substantially aligned along the cam axis 28 with the second side surface of the pin ejection portion 60 of the control groove 38, such that the reverse rotation guide surface 70 biases the lobe pack 26 to the right of the page as viewed in the Figures, so that the first shifting pin 40 and the second shifting pin 41 are directed toward and into the first position portion 62 of the control groove 38.

Figure 2:
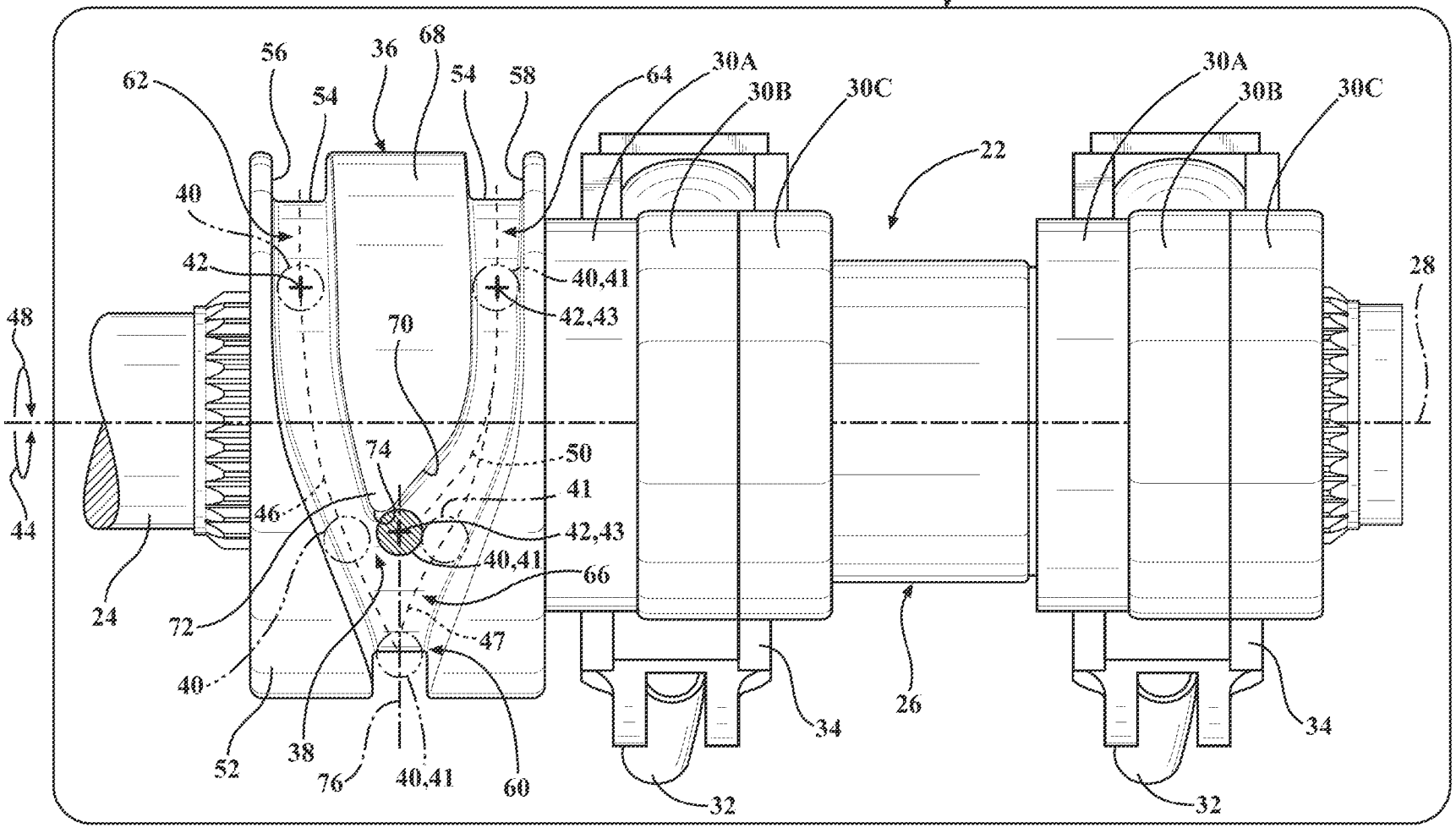
FIG. 2 is a schematic plan view of the camshaft assembly shown in a second position, while rotating in a second rotational direction.
Figure 3:
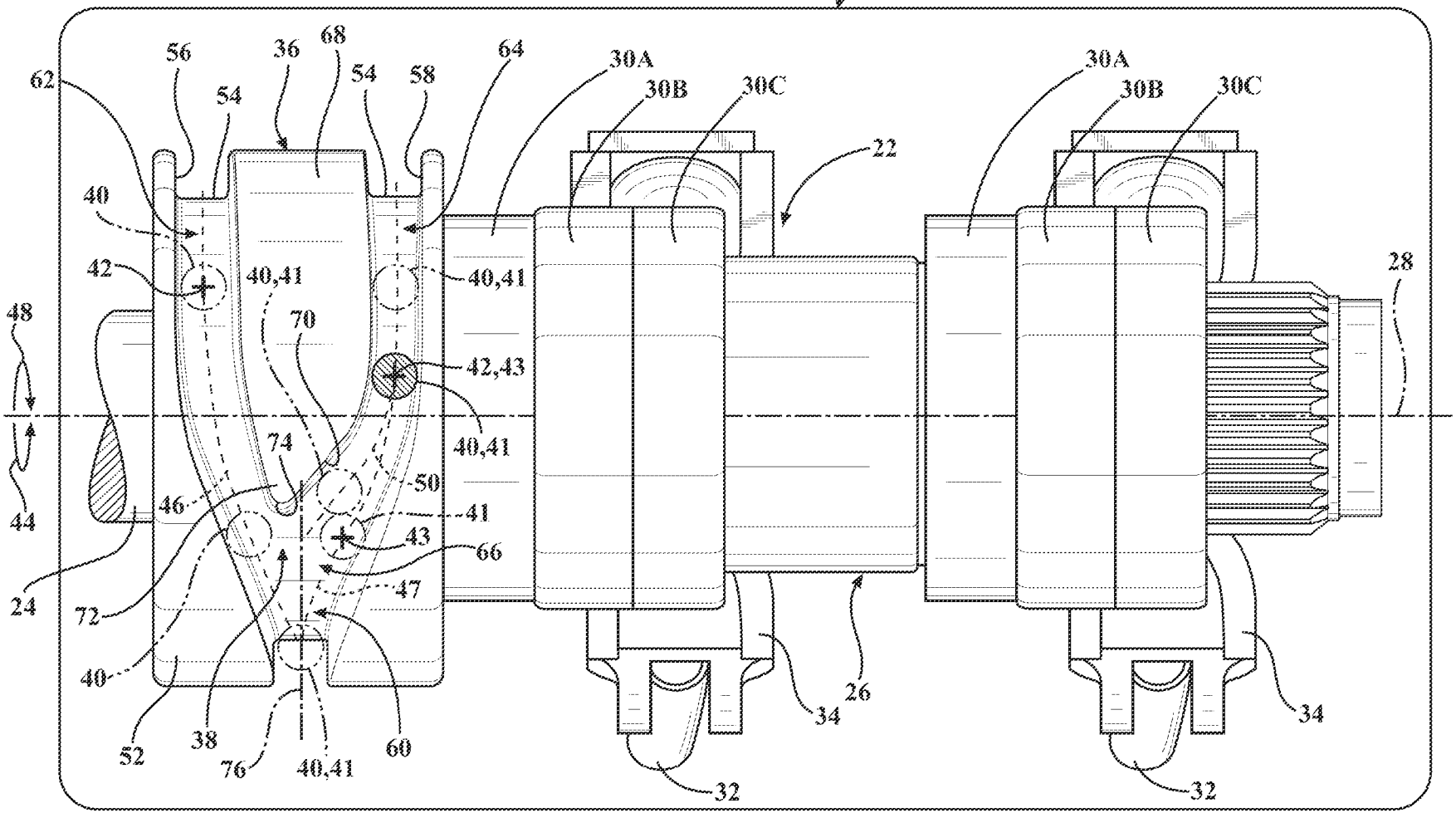
FIG. 3 is a schematic plan view of the camshaft assembly shown in a third position, while rotating in the second rotational direction.

As shown in the Figures, during normal operation of the internal combustion engine 20, in which the camshaft 24 and the lobe pack 26 rotate in the first rotational direction 44, the lobe pack 26 may follow either the first path 46, or the third path 47. When the lobe pack 26 moves along the first path 46, the first shifting pin 40 follows or moves within the first position portion 62 of the control groove 38, and is directed by the shift portion 66 of the control groove 38 into the pin ejection portion 60 of the control groove 38. When the lobe pack 26 moves along the third path 47, the second shifting pin 41 follows or moves within the second position portion 64 of the control groove 38, and is directed by the shift portion 66 of the control groove 38 into the pin ejection portion 60 of the control groove 38. In the event that the camshaft 24 and lobe pack 26 reverse rotation, and rotate in the second rotational direction 48, the lobe pack 26 follows the second path 50. Beginning with reference to FIG. 1, when the lobe pack 26 moves along the second path 50, either of the first shifting pin 40 or the second shifting pin 41 follows the pin ejection portion 60 of the control groove 38 into the shift portion 66, whereby the reverse rotation guide surface 70 is brought into contact with either the first shifting pin 40 or the second shifting pin 41, which is shown in FIG. 2. Within the Figures as shown in their respective pages, either of the first shifting pin 40 and the second shifting pin 41 appear to move or rotate about the cam axis 28 relative to the barrel cam 36. However, as noted above, the first shifting pin 40 and the second shifting pin 41 remain axially stationary along the cam axis 28, and do not rotate about the cam axis 28. Rather, the camshaft assembly 22 is shown rotated relative to either the first shifting pin 40 or the second shifting pin 41 so that the relative positions of the shifting pin 40 and the shifting pin 41 within the control groove 38 may be better shown. Because the apex 74 is shifted off center from the pin ejection portion 60 of the control groove 38, either of the first shifting pin 40 or the second shifting pin 41 are not impinged upon the apex 74, but rather contacts the reverse rotation guide surface 70 of the central guide portion 68, thereby preventing damage to either the first shifting pin 40 or the second shifting pin 41. Because the reverse rotation guide surface 70 is angled relative to the direction of rotational movement of the lobe pack 26, in the second direction of rotation, the lobe pack 26 is biased to the left as viewed in the Figures as the lobe pack 26 continues to rotate in the second rotational direction 48, until either the first shifting pin 40 or the second shifting pin 41 is disposed in the second position portion 64 of the control groove 38, which is shown in FIG. 3. As noted above, if the first shifting pin 40 is guided along the second path 50 into the second position portion 64, then the valve stems 32 will align with their respective third lobe 30C. However, if the second shifting pin 41 is guided along the second path 50 into the second position portion 64, then the valve stems will align with their respective second lobe 30B.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. An internal combustion engine comprising:

a camshaft rotatable about a cam axis;

a lobe pack slideably attached to the camshaft for axial movement along the cam axis relative to the camshaft, and rotatable with the camshaft about the cam axis, wherein the lobe pack includes a barrel cam defining a control groove disposed annularly about the cam axis;

at least one shifting pin moveable along a respective pin axis in a direction transverse to the cam axis between an engaged position and a disengaged position;

wherein the at least one shifting pin is engaged with the control groove when disposed in the engaged position, such that interaction between the at least one shifting pin and the control groove moves the lobe pack axially along the cam axis relative to the camshaft as the lobe pack rotates about the cam axis with the camshaft;

wherein the at least one shifting pin is disengaged from the control groove, such that the lobe pack remains positionally fixed along the cam axis relative to the camshaft as the lobe pack rotates about the cam axis with the camshaft, when the at least one shifting pin is disposed in the disengaged position;

wherein the control groove is shaped to engage the at least one shifting pin and guide the lobe pack along a first path to position the lobe pack in a first axial position relative to the camshaft, when the camshaft and the lobe pack rotate about the cam axis in a first rotational direction;

wherein the control groove is shaped to engage the at least one shifting pin and guide the lobe pack along a third path to position the lobe pack in a second axial position relative to the camshaft, when the camshaft and the lobe pack rotate about the cam axis in the first rotational direction;

wherein the control groove is shaped to engage the at least one shifting pin and guide the lobe pack along a second path to position the lobe pack in the second axial position relative to the camshaft, when the camshaft and the lobe pack rotate about the cam axis in a second rotational direction;

wherein the control groove is recessed into the barrel cam to define a bottom groove surface, a first side groove surface, and a second side groove surface; and wherein the barrel cam includes a central guide portion disposed within the control groove, extending radially outward from the bottom groove surface and away from the cam axis, and disposed between the first side groove surface and the second side groove surface to partially bifurcate the control groove to define the first path, the second path, and the third path.

2. An internal combustion engine as set forth in claim 1 wherein the at least one shifting pin includes a first shifting pin and a second shifting pin, and wherein:

the first shifting pin is moveable along a first pin axis in a direction transverse to the cam axis between an engaged position and a disengaged position;

the first shifting pin is engaged with the control groove when disposed in the engaged position, such that interaction between the first shifting pin and the control groove moves the lobe pack axially along the cam axis relative to the camshaft, in a first axial direction, as the lobe pack rotates about the cam axis with the camshaft;

the second shifting pin is moveable along a second pin axis in a direction transverse to the cam axis between an engaged position and a disengaged position;

the second shifting pin is engaged with the control groove when disposed in the engaged position, such that interaction between the second shifting pin and the control groove moves the lobe pack axially along the cam axis relative to the camshaft, in a second axial direction, opposite the first axial direction, as the lobe pack rotates about the cam axis with the camshaft;

the control groove is shaped to engage the first shifting pin and guide the lobe pack along the first path to position the lobe pack in the first axial position relative to the camshaft, when the camshaft and the lobe pack rotate about the cam axis in the first rotational direction;

the control groove is shaped to engage the second shifting pin and guide the lobe pack along a third path to position the lobe pack in the second axial position relative to the camshaft, when the camshaft and the lobe pack rotate about the cam axis in the first rotational direction; and wherein the control groove is shaped to react against either the first shifting pin or the second shifting pin to guide the lobe pack along a second path to position the lobe pack in the second axial position relative to the camshaft, when the camshaft and the lobe pack rotate about the cam axis in the second rotational direction.

3. An internal combustion engine as set forth in claim 2 wherein the central guide portion presents a reverse rotation guide surface for contacting the at least one shifting pin and directing the lobe pack along the second path when the lobe pack and the camshaft rotate in the second rotational direction.

4. An internal combustion engine as set forth in claim 3 wherein the control groove includes a pin ejection portion, a first position portion, a second position portion, and a shift portion;

wherein the first position portion and the second position portion are each disposed parallel with each other;

wherein the shift pin ejection portion is disposed axially between the first position portion and the second position portion along the cam axis; and wherein the shift portion connects the first position portion and the second position portion with the shift pin ejection portion, such that the shift portion transitions the first path from the first position portion into the pin ejection portion, transitions the third path from the second position portion into the pin ejection portion, and transitions the second path from the pin ejection portion into the second position portion.

5. An internal combustion engine as set forth in claim 4 wherein the central guide portion includes an end portion that defines the reverse rotation guide surface, and is disposed within the shift portion of the control groove.

6. An internal combustion engine as set forth in claim 5 wherein the end portion includes an apex disposed opposite the pin ejection portion of the control groove.

7. An internal combustion engine as set forth in claim 6 wherein the apex of the end portion is axially offset along the cam axis relative to a centerline of the pin ejection portion of the control groove, such that either the first shifting pin or the second shifting pin contact the reverse rotation guide surface when the cam lobe and the camshaft rotate about the cam axis in the second rotational direction, without impinging upon the apex.

8. An internal combustion engine as set forth in claim 7 wherein the apex is disposed axially nearer the first position portion than the second position portion of the control groove.

9. An internal combustion engine as set forth in claim 8 wherein the apex is substantially aligned along the cam axis with the first side surface of the pin ejection portion of the control groove.

10. An internal combustion engine as set forth in claim 7 wherein the apex is not centered along the centerline of the pin ejection portion of the control groove.

11. An internal combustion engine as set forth in claim 2 wherein the control groove includes a reverse rotation guide surface positioned to engage either the first shifting pin or the second shifting pin when the lobe pack rotates in the second rotational direction, and to guide the lobe pack along the second path.

12. A camshaft assembly for an internal combustion engine, the camshaft assembly comprising:

a camshaft rotatable about a cam axis;

a lobe pack slideably attached to the camshaft for axial movement along the cam axis relative to the camshaft, and rotatable with the camshaft about the cam axis, wherein the lobe pack includes a barrel cam defining a control groove disposed annularly about the cam axis;

wherein the control groove is shaped to react against a first shifting pin to guide the lobe pack along a first path to position the lobe pack in a first axial position relative to the camshaft, when the camshaft and the lobe pack rotate about the cam axis in a first rotational direction;

wherein the control groove is shaped to react against a second shifting pin to guide the lobe pack along a third path to position the lobe pack in a second axial position relative to the camshaft, when the camshaft and the lobe pack rotate about the cam axis in the first rotational direction;

wherein the control groove is shaped to react against either the first shifting pin or the second shifting pin to guide the lobe pack along a second path to position the lobe pack in the second axial position relative to the camshaft, when the camshaft and the lobe pack rotate about the cam axis in a second rotational direction; and wherein the barrel cam includes a central guide portion disposed within the control groove to partially bifurcate the control groove to define the first path, the second path, and the third path.

13. A camshaft assembly as set forth in claim 12 wherein the central guide portion presents a reverse rotation guide surface for contacting either the first shifting pin or the second shifting pin, and directing the lobe pack along the second path when the lobe pack and the camshaft rotate in the second rotational direction.

14. A camshaft assembly as set forth in claim 13 wherein the control groove includes a pin ejection portion, a first position portion, a second position portion, and a shift portion;

wherein the first position portion and the second position portion are each disposed parallel with each other;

wherein the shift pin ejection portion is disposed axially between the first position portion and the second position portion along the cam axis; and wherein the shift portion connects the first position portion and the second position portion with the shift pin ejection portion, such that the shift portion transitions the first path from the first position portion into the pin ejection portion, transitions the third path from the second position portion into the pin ejection portion, and transitions the second path from the pin ejection portion into the second position portion.

15. A camshaft assembly as set forth in claim 14 wherein the central guide portion includes an end portion that defines the reverse rotation guide surface, and is disposed within the shift portion of the control groove.

16. A camshaft assembly as set forth in claim 15 wherein the end portion includes an apex disposed opposite the pin ejection portion of the control groove.

17. A camshaft assembly as set forth in claim 16 wherein the apex of the end portion is axially offset along the cam axis relative to a centerline of the pin ejection portion of the control groove, such that either the first shifting pin or the second shifting pin contact the reverse rotation guide surface when the cam lobe and the camshaft rotate about the cam axis in the second rotational direction, without impinging upon the apex.

* * * * *